US011613453B2

(12) United States Patent
Weiss et al.

(10) Patent No.: US 11,613,453 B2
(45) Date of Patent: Mar. 28, 2023

(54) VARIABLE HYDRAULIC PRESSURE RELIEF SYSTEMS AND METHODS FOR A MATERIAL HANDLING VEHICLE

(71) Applicant: The Raymond Corporation, Greene, NY (US)

(72) Inventors: Thomas R. Weiss, Port Crane, NY (US); Eric A. Smith, Sidney Center, NY (US)

(73) Assignee: The Raymond Corporation, Greene, NY (US)

( * ) Notice: Subject to any disclaimer, the term of this patent is extended or adjusted under 35 U.S.C. 154(b) by 303 days.

(21) Appl. No.: 17/004,874

(22) Filed: Aug. 27, 2020

(65) Prior Publication Data

US 2021/0061633 A1 Mar. 4, 2021

Related U.S. Application Data

(60) Provisional application No. 62/893,658, filed on Aug. 29, 2019.

(51) Int. Cl.
*B66F 9/22* (2006.01)
*F15B 19/00* (2006.01)

(52) U.S. Cl.
CPC ..... *B66F 9/22* (2013.01); *F15B 19/002* (2013.01); *F15B 2211/50518* (2013.01); *F15B 2211/6653* (2013.01)

(58) Field of Classification Search
CPC ..... B66F 9/22; F15B 19/002; F15B 2211/50518; F15B 2211/6653
See application file for complete search history.

(56) References Cited

U.S. PATENT DOCUMENTS 6,322,164 B1 * 11/2001 Sakamoto ..... B60T 13/686 303/114.3
8,050,835 B2 * 11/2011 Wilson ..... F16D 48/066 701/67
8,776,511 B2 7/2014 Zhang
8,833,177 B2 * 9/2014 McDaniel ..... G01F 1/46 73/861.65

(Continued)

FOREIGN PATENT DOCUMENTS

EP 0924160 A2 6/1999
EP 3348514 A1 7/2018
EP 3378826 A1 9/2018

*Primary Examiner* — Dustin T Nguyen
(74) *Attorney, Agent, or Firm* — Quarles & Brady LLP

(57) ABSTRACT

A method for controlling a hydraulic control system that includes a variable pressure relief valve and may include steps for calibrating the hydraulic control system. The hydraulic control system may be calibrated by: controlling, with the controller, the variable pressure relief valve to move to a fully open position, increasing, with the pump, a fluid pressure upstream of the variable pressure relief valve, controlling, with the controller, the variable pressure relief valve to move from the fully open position toward a fully closed position by adjusting a control signal supplied to the variable pressure relief valve, monitoring, with the controller, the pressure detected by the pressure sensor, and recording, with the controller, a parameter of the control signal supplied to the variable pressure relief valve when the pressure detected by the pressure sensor reaches a target pressure.

20 Claims, 4 Drawing Sheets

(56) References Cited

U.S. PATENT DOCUMENTS

| | | | | |
|---|---|---|---|---|
| 8,899,143 | B2 | 12/2014 | Ho | |
| 9,290,366 | B2 | 3/2016 | Jones, Jr. | |
| 10,844,880 | B2 * | 11/2020 | Tracy | F15B 11/16 |
| 2009/0031720 | A1 | 2/2009 | Son | |
| 2010/0089704 | A1 | 4/2010 | Petronek | |
| 2018/0202468 | A1 | 7/2018 | Tracy | |
| 2020/0141089 | A1 * | 5/2020 | Muraoka | E02F 9/2296 |

* cited by examiner

VARIABLE HYDRAULIC PRESSURE RELIEF SYSTEMS AND METHODS FOR A MATERIAL HANDLING VEHICLE

CROSS-REFERENCE TO RELATED APPLICATIONS

The present application is based on and claims priority to U.S. Provisional Patent Application No. 62/893,658, filed on Aug. 29, 2019, which is incorporated herein by reference in its entirety.

STATEMENT REGARDING FEDERALLY SPONSORED RESEARCH

Not applicable.

BACKGROUND

In some material handling vehicles (MHVs), for example, a hydraulic lift system may be used to raise and lower a fork assembly that is holding a load.

BRIEF SUMMARY

The present invention relates generally to hydraulic lift systems and, more specifically, to hydraulic pressure relief systems and methods on MHVs.

In one aspect, the present disclosure provides a method for controlling a hydraulic control system of a material handling vehicle. The hydraulic control system includes a pump having a pump outlet in fluid communication with a supply passage, a reservoir in fluid communication with a return passage, one or more hydraulic actuators configured to raise and lower a fork assembly attached to a mast of the material handling vehicle, a variable pressure relief valve configured to selectively provide fluid communication from the supply passage to the reservoir, and a controller in communication with the variable pressure relief valve and a pressure sensor configured to measure a fluid pressure in the supply passage. The method includes calibrating the hydraulic control system by performing steps of controlling, with the controller, the variable pressure relief valve to move to a fully open position, increasing, with the pump, a fluid pressure upstream of the variable pressure relief valve, controlling, with the controller, the variable pressure relief valve to move from the fully open position toward a fully closed position by adjusting a control signal supplied to the variable pressure relief valve, monitoring, with the controller, the pressure detected by the pressure sensor, and recording, with the controller, a parameter of the control signal supplied to the variable pressure relief valve when the pressure detected by the pressure sensor reaches a target pressure.

In another aspect, the present disclosure provides a method for controlling a hydraulic control system for a material handling vehicle. The hydraulic control system includes a pump having a pump outlet in fluid communication with a supply passage, a reservoir in fluid communication with a return passage, one or more hydraulic actuators configured to raise and lower a fork assembly attached to a mast of the material handling vehicle, a variable pressure relief valve configured to selectively provide fluid communication from the supply passage to the reservoir, and a controller in communication with the variable pressure relief valve and a pressure sensor configured to measure a fluid pressure in the supply passage. The method includes calibrating the hydraulic control system by performing steps of supplying, via the controller, a minimum current magnitude to a solenoid of the variable pressure relief valve, commanding the a motor a motor driving the pump to run at a maximum pump motor speed thereby increasing a fluid pressure in the supply line, incrementally increasing a magnitude of the current supplied to the solenoid of the variable pressure relief valve, thereby increasing the pressure in the supply line, determining, as the magnitude of current supplied to the solenoid is incrementally increased, if a pressure measured by the pressure sensor reaches a target pressure, and upon determining that the pressure measured by the pressure sensor reaches the target pressure, recording the magnitude of current supplied to the solenoid that corresponds with the target pressure.

In another aspect, the present disclosure provides a hydraulic control system for a material handling vehicle. The material handling vehicle includes a pump having a pump outlet in fluid communication with a supply passage, a reservoir in fluid communication with a return passage, one or more hydraulic actuators configured to raise and lower a fork assembly attached to a mast of the material handling vehicle. The hydraulic control system includes a variable pressure relief valve and a controller. The variable pressure relief valve is configured to selectively provide fluid communication from the supply passage to the reservoir when a pressure upstream of the variable pressure relief valve exceeds a variable pressure threshold. The controller is in communication with a pressure sensor, a height sensor, and the variable pressure relief valve. The pressure sensor is configured to measure a pressure in the supply passage, and the height sensor is configured to measure a height of the fork assembly. The controller is configured to set the variable pressure threshold based on the height of the fork assembly by supplying a control signal to the variable pressure relief valve. The controller is configured to calibrate the hydraulic control system by performing the steps of commanding the variable pressure relief valve to move to a fully open position, controlling the pump to increase a pressure in the supply passage, controlling the variable pressure relief valve to incrementally move from the fully open position toward a fully closed position by adjusting the control signal supplied to the variable pressure relief valve, monitoring the pressure detected by the pressure sensor, and recording a parameter of the control signal supplied to the variable pressure relief valve when the pressure detected by the pressure sensor reaches a target pressure.

The foregoing and other aspects and advantages of the disclosure will appear from the following description. In the description, reference is made to the accompanying drawings which form a part hereof, and in which there is shown by way of illustration a preferred configuration of the disclosure. Such configuration does not necessarily represent the full scope of the disclosure, however, and reference is made therefore to the claims and herein for interpreting the scope of the disclosure.

DETAILED DESCRIPTION

Figure 1:
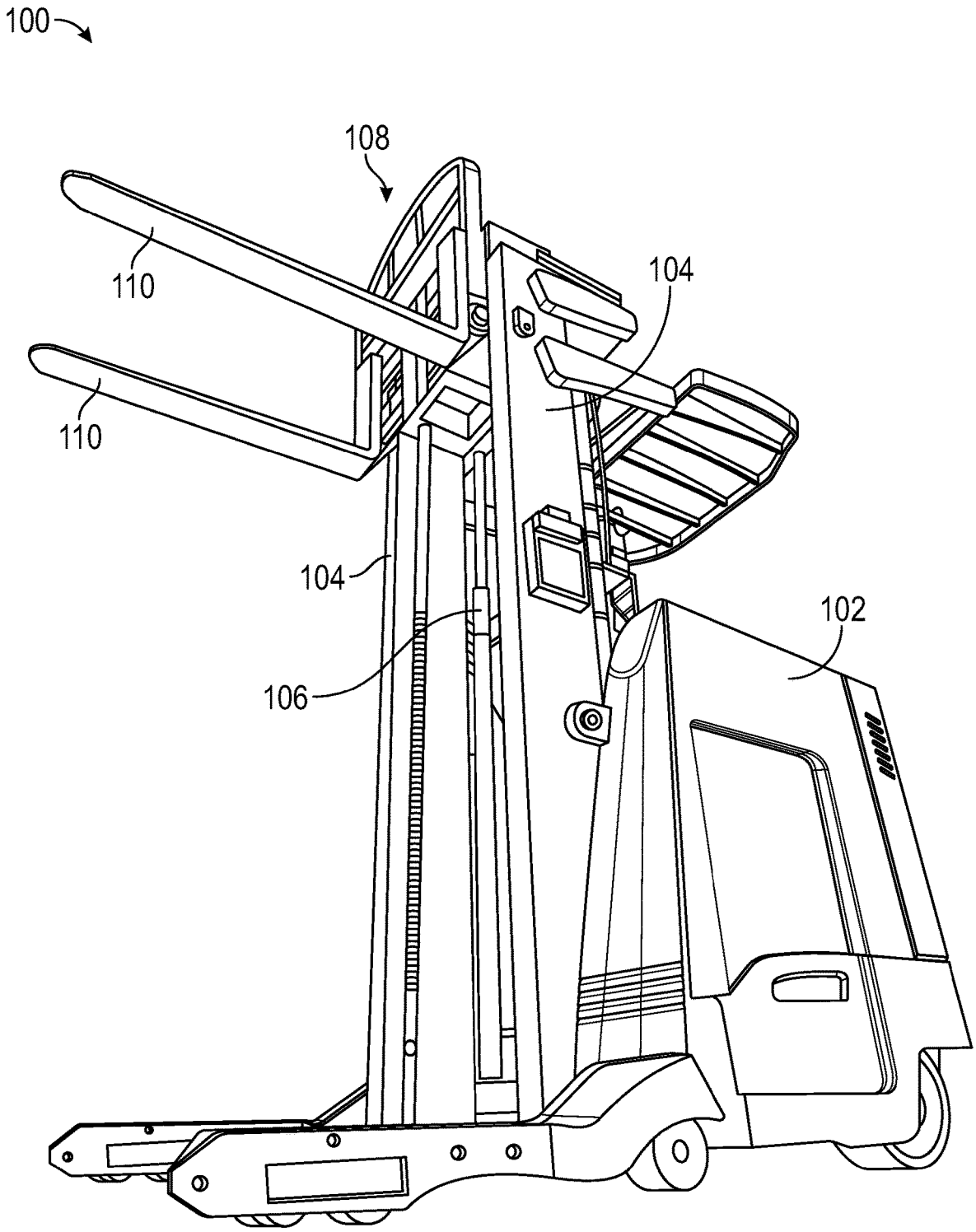
FIG. 1 is a bottom, front, left isometric view of a material handling vehicle in accordance with the present invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Also as used herein, unless otherwise specified or limited, directional terms are presented only with regard to the particular embodiment and perspective described. For example, reference to features or directions as "horizontal," "vertical," "front," "rear," "left," "right," and are generally made with reference to a particular figure or example and are not necessarily indicative of an absolute orientation or direction. However, relative directional terms for a particular embodiment may generally apply to alternative orientations of that embodiment. For example, "front" and "rear" directions or features (or "right" and "left" directions or features, and so on) may be generally understood to indicate relatively opposite directions or features. The use of the terms "downstream" and "upstream" herein are terms that indicate direction relative to the flow of a fluid. The term "downstream" corresponds to the direction of fluid flow, while the term "upstream" refers to the direction opposite or against the direction of fluid flow.

It is also to be appreciated that material handling vehicles (MHVs) are designed in a variety of configurations to perform a variety of tasks. Although the MHV described herein is shown by way of example as a reach truck, it will be apparent to those of skill in the art that the present invention is not limited to vehicles of this type, and can also be provided in various other types of MHV configurations, including for example, orderpickers, swing reach vehicles, and any other lift vehicles. The various pressure relief configurations are suitable for both driver controlled, pedestrian controlled and remotely controlled MHVs.

The various hydraulic components of hydraulic lift systems of MHVs can be sized to withstand a predetermined load, or pressure, at a specified height. Once the MHV's required capabilities are determined, the various hydraulic components can be sized appropriately. Conventional hydraulic pressure relief systems on MHVs are generally set to relieve system pressure at slightly above a predetermined hydraulic pressure that can be exerted on the system. This predetermined hydraulic pressure typically varies based on the elevation of a load carried by the MHV.

Disclosed herein is a pressure relief system that includes a variable pressure relief valve that can be adjusted with a controller to provide multiple pressure relief thresholds. In some embodiments, the hydraulic control system can be calibrated so that the controller can accurately adjust the variable pressure relief valve to provide a target pressure relief threshold.

FIG. 1 illustrates an MHV 100 according to one non-limiting example of the present disclosure. The MHV 100 can include a base 102, a telescoping mast 104, one or more hydraulic actuators 106, and a fork assembly 108. The telescoping mast 104 can be coupled to the hydraulic actuators 106 so that the hydraulic actuators 106 can selectively extend or retract the telescoping mast 104. For example, the hydraulic actuators 106 can be configured in a piston-cylinder arrangement. The fork assembly 108 can be coupled to the telescoping mast 104 so that when the telescoping mast 104 is extended or retracted, the fork assembly 108 can also be raised or lowered. The fork assembly 108 can further include one or more forks 110 on which one or more loads (not shown) can be manipulated or carried by the MHV 100.

Figure 2:
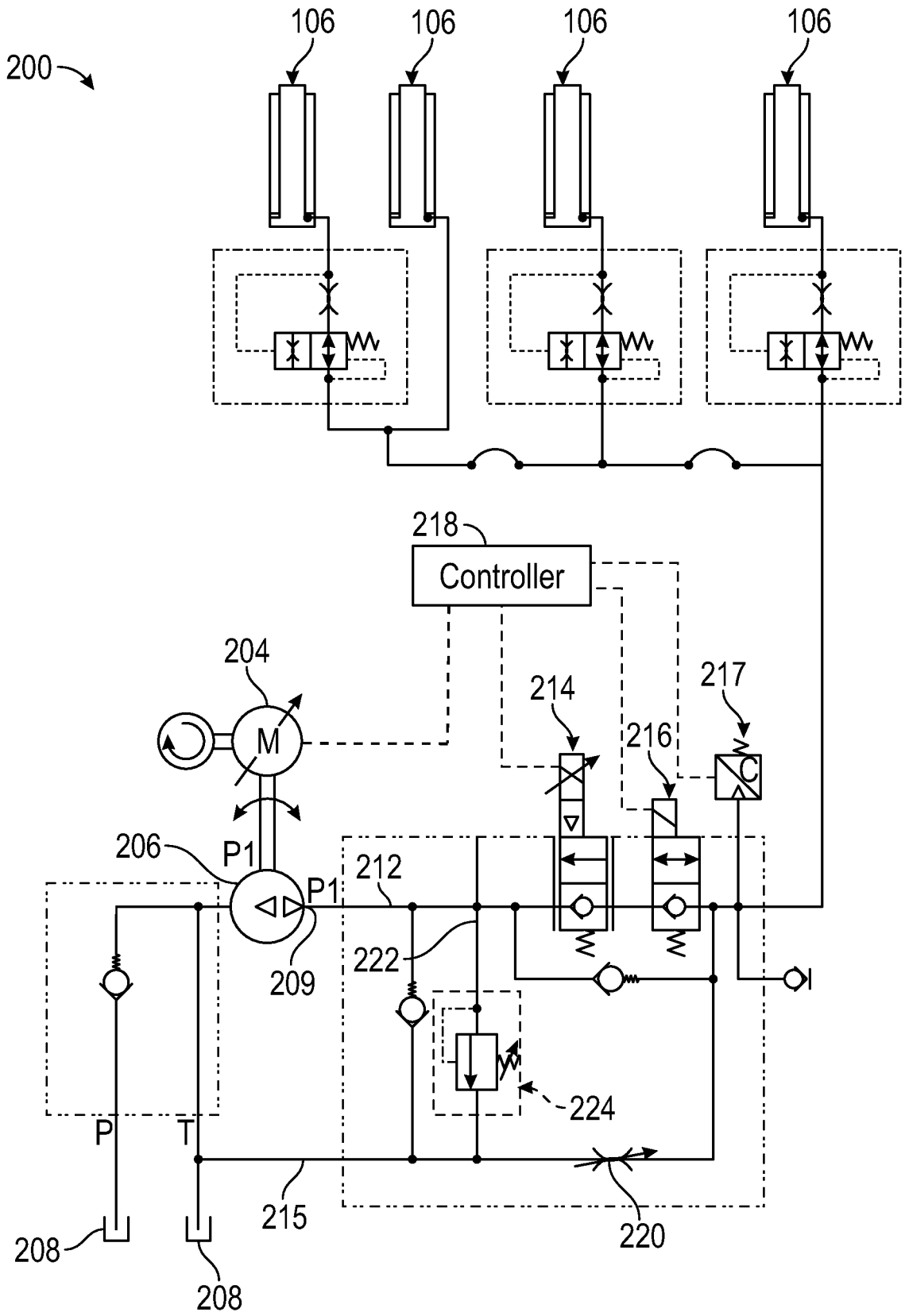
FIG. 2 is a schematic illustration of a hydraulic circuit of the material handling vehicle of FIG. 1.

FIG. 2 illustrates a hydraulic circuit 200 with a single-stage relief system that can be used to control the hydraulic actuator 106 of the MHV 100. It should be appreciated that the hydraulic circuit 200 can also be used to control other hydraulic components on the MHV 100. The hydraulic circuit 200 can include a motor 204 configured to drive a pump 206, and a reservoir tank 208. When driven by the motor 204, the pump 206 may draw fluid from the reservoir tank 208 and furnish the fluid, under increased pressure, at a pump outlet 209 in fluid communication with a supply passage 212. A first control valve 214 and a second control valve 216 may be arranged on the supply passage 212 with the first control valve 214 arranged between the pump 206 and the second control valve 216. A pressure sensor 217 can additionally be arranged on the supply passage 212 between the second control valve 216 and the hydraulic actuators, and can be configured to measure a pressure between the second control valve 216 and the hydraulic actuators 106.

The motor 204, and thereby the pump 206, the first and second control valves 214, 216, and the pressure sensor 217 can be in electrical communication with a controller 218. The controller 218 can be configured to selectively actuate the first control valve 214 and/or the second control valve 216 to direct fluid flow between the hydraulic actuators 106, the supply passage 212, and the reservoir tank 208. For example, the first and second control valves 214, 216 can be selectively actuated to either provide pressurized fluid from the pump 206 to a head side of the hydraulic actuators 106 (e.g., to extend the hydraulic actuators 106), or provide fluid communication between a rod side of the hydraulic actuators 106 and the reservoir tank 208 (e.g., to retract the hydraulic actuators 106).

With continued reference to FIG. 2, the hydraulic circuit 200 can include a return passage 215 configured to provide fluid communication from a location between the hydraulic actuators 106 and the second control valve 216 to the reservoir tank 208. In some non-limiting examples, a variable orifice 220 can be arranged on the return passage 215 at a location upstream of the reservoir tank 208. The variable orifice 220 can be configured to build pressure at a location downstream of the hydraulic actuators 106 and upstream of the reservoir tank 208 on the return passage 215 to ensure the hydraulic actuators 106 retract at a predetermined rate. In some non-limiting examples, the return passage 215 may bypass the first control valve 214 and the second control valve 216 to enable selective retraction of the hydraulic actuators 106 (i.e., lowering of the forks 110). In some non-limiting examples, the variable orifice 220 may close off, or substantially close off, to allow fluid flow through the first and second control valves 214 and 216 and through the pump 206 during retraction. The back flow through the pump 206 may spin the motor 204 in an opposing direction, compared to when it is supplying pressurized fluid to the supply passage 212, which enables the motor 204 to recover energy and, for example, charge a battery on the MHV 100.

The hydraulic circuit 200 can additionally include a relief line 222 configured to provide fluid communication from the supply passage 212 at a location between the first control valve 214 and the pump 206 to the return passage 215 at a location downstream of the variable orifice 220. In some non-limiting examples, fluid flow through the relief line 222 may be controlled by a pressure relief valve 224 arranged on the relief line 222. When the pressure upstream of the pressure relief valve 224 (i.e., in the supply passage 212 between the pump 206 and the first control valve 214) exceeds a pressure relief threshold, the pressure relief valve 224 can move from a closed position in which flow through the relief line 222 is restricted, to an open position in which flow through the relief line 222 is permitted. This may be useful, for example, in order to limit a system pressure downstream of the pump outlet 209 (e.g., in the supply passage 212).

Figure 3:
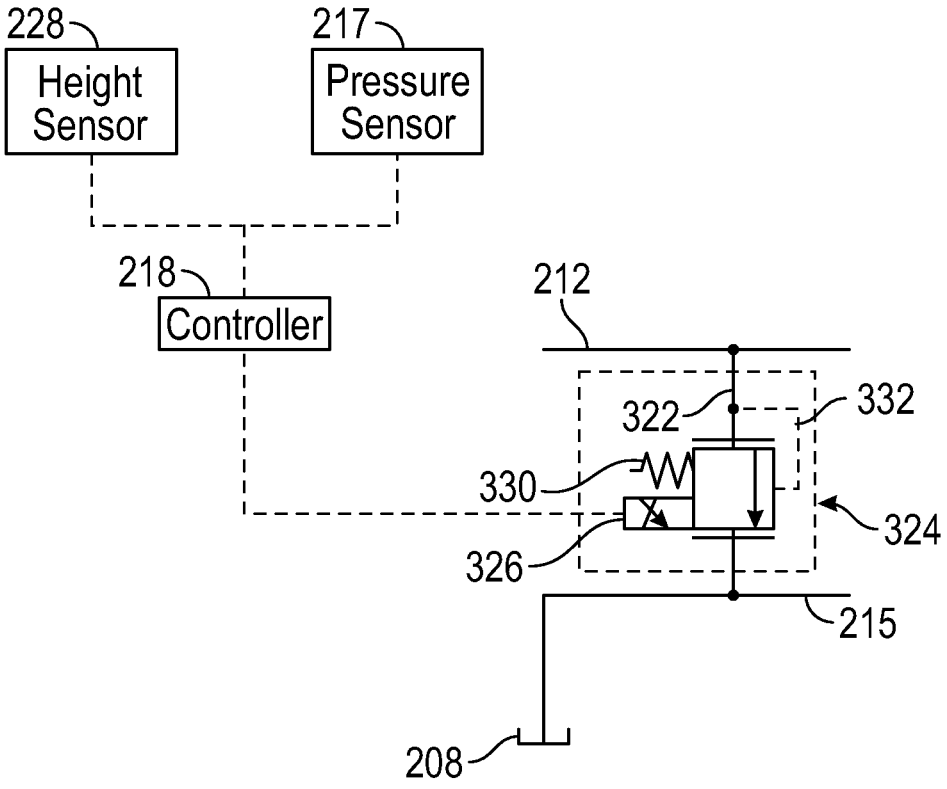
FIG. 3 is a schematic illustration of a pressure relief system including a variable pressure relief valve.

Hydraulic circuits according to the present invention can include various pressure relief systems that may include at least one of single stage pressure relief valve(s), multi-stage pressure relief valve(s), or variable pressure relief valve(s). For example, FIG. 3 illustrates a pressure relief system 300 that can be implemented in the hydraulic circuit of FIG. 2 in addition to, or in place of, the pressure relief valve 224. The pressure relief system 300 can include a variable pressure relief valve 324 that can be controlled by the controller 218 to provide a variable pressure relief threshold setting. In the illustrated non-limiting example, for example, the variable pressure relief valve 324 can include a solenoid 326 in electrical communication with controller 218 and configured to move the variable pressure relief valve 324 between an open position (e.g., fluid communication is provided between the supply passage 212 and the reservoir tank 208), a closed position (e.g., fluid communication is inhibited between the supply passage 212 and the reservoir tank 208), and any position between the open position and the closed position in order to adjust the pressure relief threshold provided by the variable pressure relief valve 324. For example, a magnitude of the electrical signal provided to the solenoid 326 may vary an output force supplied by the solenoid 326 to the variable pressure relief valve 324, which alters a force balance on the variable pressure relief valve 324 and thereby adjusts the pressure relief threshold. In the illustrated non-limiting example, a spring 330 and the solenoid 326 act on one side of the variable pressure relief valve 324 and the force from the fluid pressure in the supply passage 212 at the location between the pump 206 and the first control valve 214 may act on an opposing side of the variable pressure relief valve 324 (e.g., via a pilot line 332). The pressure relief threshold may be defined by the combined force of the spring 330 (a constant) and the solenoid 326. That is, the variable pressure relief valve 324 may move to an open position (i.e., where fluid communication is provided between the supply passage 212 and the reservoir tank 208) when a force supplied by the pressure in the pilot line 332 is greater than the combined force of the spring 330 and the solenoid 326.

The pressure relief threshold may be variably set with a control signal provided from the controller 218 to the solenoid 326 and may be adjusted in order to move the solenoid 326 through the range of solenoid positions. For example, at least one of a current level, a voltage level, a frequency, or any other control signal parameter of the control signal may be adjusted by the controller 218 to actuate the solenoid 326 and adjust an output force provided by the solenoid 326 and, thereby, provide a variable pressure relief threshold. In one non-limiting example, the solenoid 326 may be a proportional solenoid that is configured to provide an output force that is related or proportional to a magnitude of a current supplied to the solenoid 326 by the controller 218. This may be useful, for example, in order to provide a variable pressure threshold based on the capacities of the hydraulic circuit 200 at varying fork assembly 108 elevations, as measured by a height sensor 328. For example, as the fork assembly 108 moves upward (i.e., the telescoping mast 104 extends), the maximum feedback pressure (e.g., pressure in the supply passage 212) for the hydraulic circuit 200 may decrease. To account for this reduced maximum pressure in the supply passage 212, the pressure relief threshold of the variable pressure relief valve 324 can be decreased.

Figure 4:
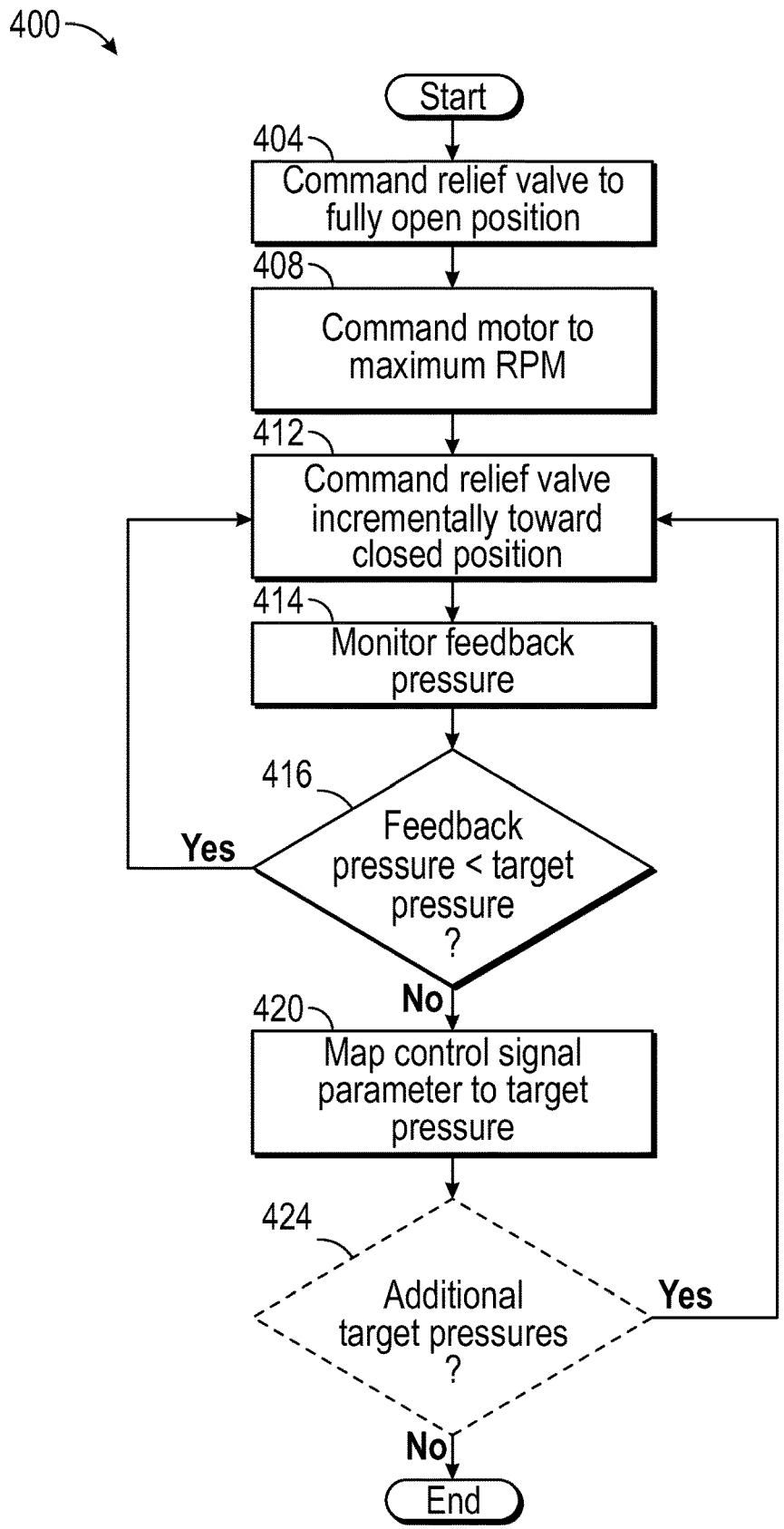
FIG. 4 is a flowchart illustrating steps for calibrating the pressure relief system of FIG. 3 when implemented in the hydraulic circuit of FIG. 2.

In some non-limiting examples, the hydraulic circuit 200 can be calibrated in order to adjust determine a position of the solenoid 326 to correspond with a desired pressure relief threshold to accurately provide the desired pressure relief threshold as a function of, for example, fork assembly 108 elevation levels. For example, FIG. 4 illustrates an example of a calibration method 400 for calibrating a pressure relief system 300 pressure relief system implemented in a hydraulic circuit 200 of the MHV 100.

At process block 404, the controller 218 can control the variable pressure relief valve 324 to move to a fully open position. This may include adjusting the control signal provided from the controller 218 to the variable pressure relief valve 324 by increasing or decreasing at least one of the voltage, the current, and the frequency of the control signal. For example, the controller 218 may be configured to supply a minimum current value to the solenoid 326, or supply no current to the solenoid 326, to enable the variable pressure relief valve 324 to move to the open position when a force provided by the fluid pressure in the supply line between the pump 206 and the first control valve 214 is greater than a force of the spring 330. The controller 218 may then control the pump 206 to increase the fluid pressure in the supply passage 212 at process block 408. In some non-limiting examples, the controller 218 can instruct the motor 204 driving the pump 206 to run at its maximum speed (e.g., revolutions per minute (RPM)) in order to increase the pressure in the supply passage 212 to a pressure that corresponds with a force that is at least greater than a force provided by the spring 230. Alternatively, the motor may be run at a slower, but constant, speed than the maximum pump motor speed to increase fluid pressure in the supply passage 212 to a pressure that corresponds with a force that is at least greater than a force provided by the spring 230. In some non-limiting examples, the fork assembly 108 may be immobilized before, during, or after the steps of process block 404 or process block 408, which may prevent the forks assembly 108, and the telescoping mast 104, from displacing during the calibration method 400.

After the pressure in the supply passage 212 has been increased and fluid is flowing through the relief line 322 (i.e., the variable pressure relief valve 324 is in the open position) to the reservoir tank 208, the variable pressure relief valve 324 can be slowly displaced toward the closed position at process block 412. The controller 218 may gradually adjust the control signal to the variable pressure relief valve 324, causing the solenoid 326 to slowly move the variable pressure relief valve 324 toward the closed position. For example, the controller 218 may incrementally increase a current supplied to the solenoid 326, which increases the force applied by the solenoid 326 and thereby increases the pressure relief threshold provided by the variable pressure relief valve 324. As the force input provided by the solenoid 326 increases, flow through the relief line 322 may be further restricted causing the fluid pressure upstream of the variable pressure relief valve 324, or in the supply passage 212, to increase. During this process, the controller 218 can monitor the pressure in the supply passage 212 detected by the pressure sensor 217 at process block 414. At process block 416, the controller 218 can check the pressure measured by the pressure sensor 217 to determine if a target feedback pressure (for example, a desired pressure relief threshold) has been reached. In some non-limiting examples, at least one step performed in process block 412 and/or process block 416 may be repeated until the pressure upstream of the variable pressure relief valve 324 or a pressure measured by the pressure sensor 217 reaches the target pressure.

Once the controller 218 determines that the pressure sensor 217 measures that the feedback pressure has reached the target pressure, the controller 218 can record the control signal parameters associated with target pressure at process block 420. For example, the controller 218 may store the current provided to the solenoid 326 of the variable pressure relief valve 324 when the pressure sensor 217 detects the target pressure. In some non-limiting examples, the control signal parameters and the associated target pressure may be stored in a memory integrated with the controller 218, a vehicle memory, a remote memory location, or in any other location or manner. The controller 218 may additionally be configured to determine if there are additional target pressures to learn at process block 424. This may be useful, for example, in order to store the control signal parameters associated with a plurality of different fork assembly 108 elevations. If the controller 218 determines that there is at least one additional target pressure to be learned, the controller 218 can repeat the steps of at least one of process block 412, 416, 420, and 424. For example, the controller 218 may continue to increase the current supplied to the solenoid 326 and further increase a pressure in the supply passage 212 at least until the next target pressure is detected by the pressure sensor 217.

In some non-limiting examples, a target pressure that the variable pressure relief valve 324 is used to map to a corresponding control signal supplied thereto (e.g., a current value) may correspond with a feedback pressure provided from at least the hydraulic actuators 106 responsible for moving the fork assembly 108. For example, the pressure in the supply passage 212 measured by the pressure sensor 217 may correspond with, or may be adjusted to correspond with (e.g., by compensating for any pressure drop between the pressure sensor 217 and the hydraulic actuators 106), a pressure in or provided to the hydraulic actuators 106 during the calibration method 400. As such, the current values provided to the solenoid 326 that correspond with the one or more target pressures learned during the calibration method 400 may be used to learn a specific load capacity of the fork assembly 108. For example, the MHV 100 may be configured to lift varying maximum load weights as a function of a height of the fork assembly 108. The various maximum load weights may correspond with various target pressures supplied to the hydraulic actuators 106, which can be learned during the calibration method 400. That is, the various current magnitudes supplied to the solenoid 326 of the variable pressure relief valve 324 may be learned during the calibration method 400 and used by the controller 218 as the fork assembly 108 traverses to various heights, which provides a variable maximum weight carried by the fork assembly 108 as a function of a height of the fork assembly 108.

In some embodiments, a method for calibrating the pressure relief system of a MHV may include at least one step that is different than the calibration method 400 illustrated in FIG. 4. For example, a controller may be configured move the variable pressure relief valve from the fully open position to the fully closed position while recording control signal parameters at predetermined intervals. In such a non-limiting example, a controller can be calibrated for a range of pressure thresholds without having a predetermined target pressure. In an embodiment with only one target pressure, the controller may omit the steps of process block 424. In still further embodiments, a method for using a hydraulic control system can include at least one additional step, which may be the same of different than at least one other step, and at least one process step may be omitted.

The previous description of the disclosed embodiments is provided to enable any person skilled in the art to make or use the invention. Various modifications to these embodiments will be readily apparent to those skilled in the art, and the generic principles defined herein may be applied to other embodiments without departing from the spirit or scope of the invention. Thus, the invention is not intended to be limited to the embodiments shown herein but is to be accorded the widest scope consistent with the principles and novel features disclosed herein.

Finally, it is expressly contemplated that any of the processes or steps described herein may be combined, eliminated, or reordered. In other embodiments, instructions may reside in computer readable medium wherein those instructions are executed by a processor to perform one or more of processes or steps described herein. As such, it is expressly contemplated that any of the processes or steps described herein can be implemented as hardware, firmware, software, including program instructions executing on a computer, or any combination of thereof. Accordingly, this description is meant to be taken only by way of example, and not to otherwise limit the scope of this invention.

We claim:

1. A method for controlling a hydraulic control system of a material handling vehicle, the hydraulic control system including a pump having a pump outlet in fluid communication with a supply passage, a reservoir in fluid communication with a return passage, one or more hydraulic actuators configured to raise and lower a fork assembly attached to a mast of the material handling vehicle, a variable pressure relief valve configured to selectively provide fluid communication from the supply passage to the reservoir, and a controller in communication with the variable pressure relief valve and a pressure sensor configured to measure a pressure in the supply passage, the method comprising:

calibrating the hydraulic control system by performing steps of:

controlling, with the controller, the variable pressure relief valve to move to a fully open position;

increasing, with the pump, a fluid pressure upstream of the variable pressure relief valve;

controlling, with the controller, the variable pressure relief valve to move from the fully open position toward a fully closed position by adjusting a control signal supplied to the variable pressure relief valve;

monitoring, with the controller, a pressure detected by the pressure sensor; and recording, with the controller, a parameter of the control signal supplied to the variable pressure relief valve when the pressure detected by the pressure sensor reaches a target pressure.

2. The method of claim 1, wherein calibrating the hydraulic control system further comprises steps for:

determining, with the controller, if there is at least one additional target pressure.

3. The method of claim 1, wherein calibrating the hydraulic control system further comprises steps of:

controlling, with the controller, the variable pressure relief valve to continue to move from the fully open position to a fully closed position after the target pressure is detected by the pressure sensor; and recording, with the controller, a parameter of the control signal supplied to the variable pressure relief valve when the pressure detected by the pressure sensor reaches an additional target pressure.

4. The method of claim 1, wherein the step of adjusting a control signal supplied to the variable pressure relief valve comprises adjusting a current magnitude of the control signal supplied to the variable pressure relief valve, and wherein the parameter of the control signal is the current magnitude of the control signal.

5. The method of claim 1, wherein the step of increasing a fluid pressure comprises instructing a motor driving the pump to run at a maximum pump motor speed.

6. The method of claim 1, wherein controlling, with the controller, the variable pressure relief valve to move to a fully open position comprises:

supplying, via the controller, a minimum current magnitude to a solenoid of the variable pressure relief valve.

7. The method of claim 1, wherein controlling, with the controller, the variable pressure relief valve to move from the fully open position toward the fully closed position by adjusting the control signal supplied to the variable pressure relief valve comprises:

incrementally increasing a current supplied to a solenoid of the variable pressure relief valve.

8. The method of claim 1, wherein the hydraulic control system includes a control valve arranged on the supply passage, and wherein the pressure sensor is arranged between the control valve and the one or more hydraulic actuators.

9. The method of claim 8, wherein the variable pressure relief valve is configured to selectively provide fluid communication from a location on the supply passage arranged between the pump and the control valve to the reservoir.

10. A method for controlling a hydraulic control system for a material handling vehicle, the hydraulic control system including a pump having a pump outlet in fluid communication with a supply passage, a reservoir in fluid communication with a return passage, one or more hydraulic actuators configured to raise and lower a fork assembly attached to a mast of the material handling vehicle, a variable pressure relief valve configured to selectively provide fluid communication from the supply passage to the reservoir, and a controller in communication with the variable pressure relief valve and a pressure sensor configured to measure a fluid pressure in the supply passage, the method comprising:

calibrating the hydraulic control system by performing steps of:

supplying, via the controller, a minimum current magnitude to a solenoid of the variable pressure relief valve;

commanding a motor driving the pump to run at a maximum pump motor speed thereby increasing a pressure in the supply passage;

incrementally increasing a magnitude of a current supplied to the solenoid of the variable pressure relief valve, thereby further increasing the pressure in the supply passage;

determining, as the magnitude of current supplied to the solenoid is incrementally increased, if a pressure measured by the pressure sensor reaches a target pressure; and upon determining that the pressure measured by the pressure sensor reaches the target pressure, recording the magnitude of current supplied to the solenoid that corresponds with the target pressure.

11. The method of claim 10, wherein calibrating the hydraulic control system further comprises steps for:

determining, with the controller, if there is at least one additional target pressure.

12. The method of claim 10, wherein calibrating the hydraulic control system further comprises steps of:

continuing to increase the magnitude of current supplied to the solenoid after the target pressure is reached; and recording another magnitude of current supplied to the solenoid when the pressure measured by the pressure sensor reaches an additional target pressure.

13. The method of claim 10, wherein the hydraulic control system includes a control valve arranged on the supply passage, and wherein the pressure sensor is arranged between the control valve and the one or more hydraulic actuators.

14. The method of claim 13, wherein the variable pressure relief valve is configured to selectively provide fluid communication from a location on the supply passage arranged between the pump and the control valve to the reservoir.

15. A hydraulic control system for a material handling vehicle, the material handling vehicle including a pump having a pump outlet in fluid communication with a supply passage, a reservoir in fluid communication with a return passage, one or more hydraulic actuators configured to raise and lower a fork assembly attached to a mast of the material handling vehicle, the hydraulic control system comprising:

a variable pressure relief valve configured to selectively provide fluid communication from the supply passage to the reservoir when a pressure upstream of the variable pressure relief valve exceeds a variable pressure threshold;

a controller in communication with a pressure sensor, a height sensor, and the variable pressure relief valve, wherein the pressure sensor is configured to measure a pressure in the supply passage, and the height sensor is configured to measure a height of the fork assembly, the controller being configured to set the variable pressure threshold based on the height of the fork assembly by supplying a control signal to the variable pressure relief valve, and wherein the controller is configured to calibrate the hydraulic control system by performing the steps of:

commanding the variable pressure relief valve to move to a fully open position;

controlling the pump to increase a pressure in the supply passage;

controlling the variable pressure relief valve to incrementally move from the fully open position toward a fully closed position by adjusting the control signal supplied to the variable pressure relief valve;

monitoring the pressure detected by the pressure sensor; and recording a parameter of the control signal supplied to the variable pressure relief valve when the pressure detected by the pressure sensor reaches a target pressure.

16. The hydraulic control system of claim 15, wherein the variable pressure relief valve includes a solenoid configured to receive the control signal.

17. The hydraulic control system of claim 16, wherein the parameter of the control signal is a magnitude of current supplied to the solenoid.

18. The hydraulic control system of claim 16, wherein the fully open position corresponds with a minimum current magnitude supplied to the solenoid.

19. The hydraulic control system of claim 15, wherein a control valve is arranged on the supply passage, and wherein the pressure sensor is arranged between the control valve and the one or more hydraulic actuators.

20. The hydraulic control system of claim 19, wherein the variable pressure relief valve is configured to selectively provide fluid communication from a location on the supply passage arranged between the pump and the control valve to the reservoir.

* * * * *